United States Patent [19]

Hagios

[11] 4,063,313

[45] Dec. 20, 1977

[54] BELT APPARATUS FOR COVERING BELT LOOPS

[76] Inventor: Frederick K. Hagios, 120 Ridgeview Circle, Princeton, N.J. 08540

[21] Appl. No.: 742,044

[22] Filed: Nov. 15, 1976

[51] Int. Cl.[2] ..... A41F 3/02

[52] U.S. Cl. ..... 2/338

[58] Field of Search ..... 2/300–338

[56] References Cited

U.S. PATENT DOCUMENTS

| | | | |
|---|---|---|---|
| 513,448 | 1/1894 | Zeltmacher | 2/308 |
| 661,225 | 11/1900 | Polak | 2/308 |
| 683,720 | 10/1901 | Arnold | 2/308 |
| 841,157 | 1/1907 | Knothe | 2/338 |
| 875,486 | 12/1907 | Askins | 2/338 |
| 1,082,486 | 12/1913 | Basch | 2/320 |
| 2,084,720 | 6/1937 | Alexandre | 2/338 X |
| 3,664,560 | 5/1972 | Perkins | 2/312 X |

*Primary Examiner*—Werner H. Schroeder
*Assistant Examiner*—Doris L. Troutman
*Attorney, Agent, or Firm*—Behr & Woodbridge

[57] ABSTRACT

A belt apparatus including a substantially rigid inner belt means and a wider decorative outer belt means is adapted to conceal the belt loops of a garment such as a pair of trousers. The inner belt means passes through the belt loops in the normal fashion except that in the preferred embodiment the ends of the inner belt means are not to be attached to each other. The outer belt means is stitched to the inner belt means at a location approximately in the center of both the inner and outer belt means. The outer belt means is wider than the inner belt means and is adapted to cover the inner belt means and the associated belt loops. A pair of snap type fasteners located near the opposite ends of the inner belt means provide further support to the outer belt means. The free ends of the outer belt means may be buckled in the conventional manner. The rigidity of the inner belt means provides support to the outer belt means. Additional or other attaching means may be employed to improve the support of the outer belt means by the inner belt means.

10 Claims, 20 Drawing Figures

BELT APPARATUS FOR COVERING BELT LOOPS

BACKGROUND OF THE INVENTION

1. Field of the Invention

This invention relates to a belt apparatus adapted to conceal the belt loops of a garment such as a pair of trousers.

2. Description of the Prior Art

The use of a belt for the purpose of supporting a garment has been known for many years. In order to facilitate the supporting action of the belt the corresponding garment frequently includes a plurality of belt loops through which a belt passes. Unfortunately, belt loops appear to be very much an after thought in the manufacturing of articles such as trousers and are believed to detract greatly from the continuity and overall appearance of the garment. Not only are the belt loops unattractive per se, they also break the smooth line of the belt. Modern belts have become highly stylized and attractive. They often include painted art, words and even trademarks which should not be periodically severed by the overlapping loops of the garment. Accordingly, a means was sought whereby the belt loops could be covered without sacrificing the supportive structure of the belt loops. In that regard, the following prior art is believed to be pertinent.

Perkins, U.S. Pat. No. 3,664,560 discloses a compound belt comprising an inner member and an outer member. The inner belt and outer belt are connected together through thistle-cloth fasteners of the sort sold under the trademark "VELCRO." The purpose of the Perkins invention appears to be to provide for a more comfortable type of "Sam Brown" belt of the sort used by law enforcement agencies. The use of "VELCRO" allows the wearer to readily attach and detach the outer belt member. While the Perkins invention is similar in some respects to the present invention, it otherwise appears to be totally different in function and structure. The Perkins invention is illustrated in FIG. 1A of the drawings.

U.S. Pat. No. 3,866,276 also issued to Perkins discloses a spring-loaded belt keeper of the sort necessary with the compound belt previously described. One of the difficulties with "VELCRO" fasteners is that they are relatively bulky and necessitate the use of devices to minimize their bulky appearance and to prevent them from inadvertently separating from their mating counterparts.

Zeltmacher, U.S. Pat. No. 513,448 discloses a compound belt which is illustrated in FIG. 1B. The belt includes an auxiliary elastic strap having loops at both ends which are adapted to be applied to the side buttons of the waist band of a pair of trousers. The purpose of the belt is to permit the drawing in of the waist band and thereby to produce a tighter trouser fit without requiring the belt to be rebuckled for comfort. The Zeltmacher device, however, appears to be irrelevant to modern trousers in that it does not provide for belt loops.

Similarly, Kronthal, U.S. Pat. No. 694,390 discloses a belt adapted for waist bands having button connectors therein. The belt illustrated in FIG. 1C includes an inner band and an outer belt portion which are connected together through a plurality of loops. It is the purpose of the Kronthal invention to provide for a garment which cannot work above its proper position. The Kronthal invention is of special interest in that it is further concerned with concealing from outer view the existence of a connecting means between the waist band and the outer belt itself. However, the Kronthal invention appears to be directed more towards older waist bands which did not provide for belt loops.

Another older belt model is disclosed by Arnold, U.S. Pat. No. 683,720 which is illustrated in FIG. 1D. That particular compound structure also appears to be directed towards waistbands having button connectors therein. It is of interest, too, in that it is also concerned with "concealing the top of the trousers so as to avoid the unsightly loops through which the belt is usually strung." Nevertheless, the Arnold invention appears to be directed more specifically towards pants having button attachments rather than loop attachments.

FIG. 1E of the drawings illustrates a belt invented by Rand and disclosed in U.S. Pat. No. 3,840,270. The belt provides for an inner belt and an outer decorative strip which may be connected to the inner belt through the use of "VELCRO" type fasteners. The Rand belt however, appears to employ the inner member as the primary element with the outer decorative strip only partially encircling the inner belt.

Also disclosed in the prior art are a variety of combined sash and belt inventions which disclose the use of an inner belt means to support an outer sash type of element. Generally, the primary purpose of those inventions appears to be to provide for a convenient means of supporting a formal sash. Disclosures directed towards that particular type of invention include: Zeltmacher, U.S. Pat. No. 428,793; Hellenberg, U.S. Pat. No. 429,910; Teel, U.S. Pat. No. 435,257; Flagg, U.S. Pat. No. 410,510; Olivarius, U.S. Pat. No. 437,340; and Hirshfeld, U.S. Pat. No. 439,244.

In addition, the following prior art appears to have some relevance with respect to the present invention: Mullee, U.S. Pat. No. 7,879; Brigham, U.S. Pat. No. 9,492; Frothingham, U.S. Pat. No. 594,201; Polak, U.S. Pat. No. 661,225; Garford et al, U.S. Pat. No. 670,708; Knothe, U.S. Pat. No. 841,157; Basch, U.S. Pat. No. 882,445; Killius, U.S. Pat. No. 926,259; Rechtschaffen, U.S. Pat. No. 1,139,310; Schlusserberg, U.S. Pat. No. 1,877,697; Blumgardt, U.S. Pat. No. 2,019,248; Alexandre, U.S. Pat. No. 2,084,720; Bensel, U.S. Pat. No. 2,427,119; Meyerson, U.S. Pat. No. 2,430,070; Spengler, U.S. Pat. No. 2,495,029; Rishcoff, U.S. Pat. No. 2,514,796; Dye et al., U.S. Pat. No. 2,885,684; Carr et al., U.S. Pat. No. 2,885,685; Girard, U.S. Pat. No. 3,426,363; Klaproth, U.S. Pat. No. 3,784,986; Kadison, U.S. Pat. No. 3,793,645; Ihmels, U.S. Pat. No. 3,828,370; Schiller, U.S. Pat. No. 3,885,250; Hirsch, U.S. Pat. No. 3,905,046; and Riggs, U.S. Pat. No. 3,940,801.

In addition French Pat. No. 1,067,650 to Dorfmann is of interest in that it also discloses the use of a decorative outer strip connected to an inner belt device.

SUMMARY OF THE INVENTION

Briefly described the invention comprises a compound belt having an inner belt means adapted to fit through the belt loops of a conventional garment and an outer belt means adapted to be supported by the inner belt means and to conceal the inner belt means when buckled in the normal fashion. The inner belt means is preferably attached to the outer belt means at a point intermediate the inner and outer belt means by a plurality of lines of stitches running approximately in the direction of the long dimension of the inner and outer belt means. The stitch lines are preferably several inches long so as to prevent twisting and so as to provide a compact off-the-shelf item. Alternative attachment means include gluing of leather to leather, bonding of a plastic inner belt to a leather outer belt and various releasable types of attachments. A snap attaching means is located near the opposite ends of said inner belt means and adapted to support the outer belt means when the inner belt means is in position. The outer belt means includes a buckle which attaches both ends of the outer belt means in the conventional manner. The rigidity of the inner belt means serves to support the trousers at the same time that it supports the outer belt means without any appreciable sagging. These and other features of the present invention will be more fully understood with reference to the following drawings.

DETAILED DESCRIPTION OF THE INVENTION

During the course of this description like numbers will be used to indicate like elements according to the different illustrations of the invention.

Relevant prior art belts have been previously discussed with respect to FIGS. 1A through 1E. Generally speaking, the prior art does not address the same problems nor does it appear to employ the same structure as that of the present invention.

Figure 1A:
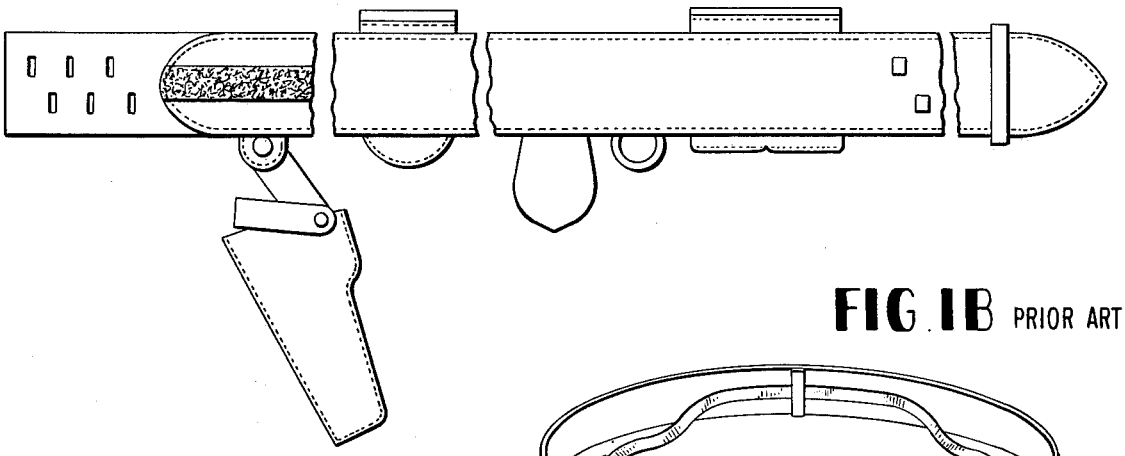
FIG. 1A PRIOR ART
FIG. 1A illustrates a prior art belt such as disclosed in U.S. Pat. No. 3,664,560.
Figure 1B:
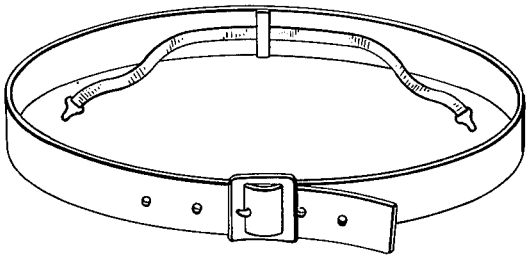
FIG. 1B PRIOR ART
FIG. 1B illustrates a prior art belt disclosed in U.S. Pat. No. 513,448.
Figure 1C:
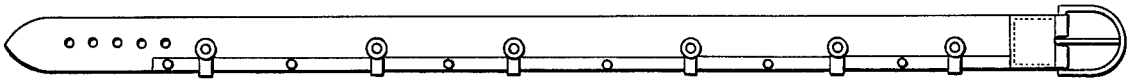
FIG. 1C PRIOR ART
FIG. 1C illustrates a prior art belt disclosed in U.S. Pat. No. 694,390.
Figure 1D:
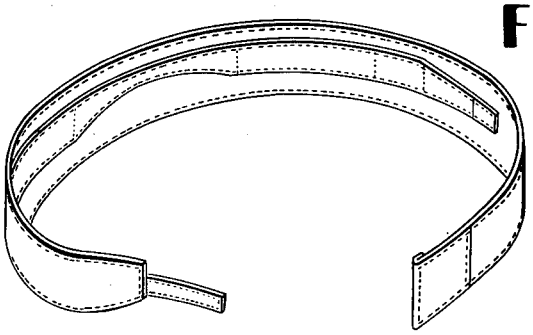
FIG. 1D PRIOR ART
FIG. 1D illustrates a prior art belt disclosed in U.S. Pat. No. 683,720.
Figure 1E:
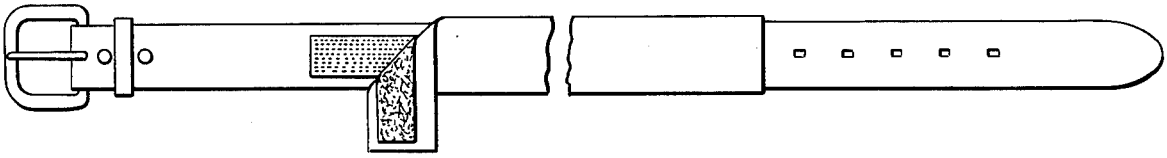
FIG. 1E PRIOR ART
FIG. 1E illustrates a prior art belt disclosed in U.S. Pat. No. 3,848,270.
Figure 2A:
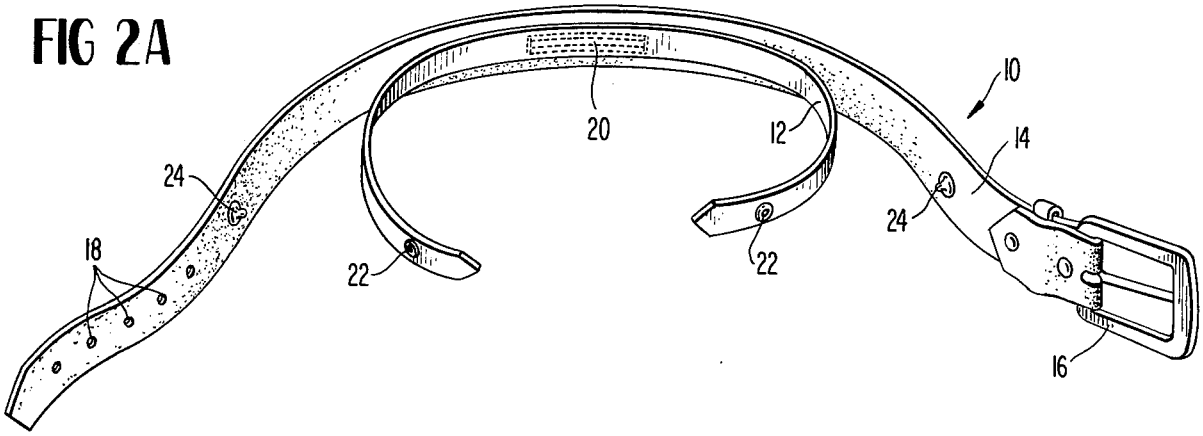
FIG. 2A is a perspective view of a compound belt according to the present invention.

A compound belt 10 is illustrated in an elevated perspective view in FIG. 2A. The belt includes an inner belt means 12 which is connected at its midpoint to an outer belt means 14. The outer belt means includes a conventional type of buckle 16 adapted to mate with suitable anchoring holes 18 at the opposite end of the outer belt 14 from the buckle 16. According to the preferred embodiment the inner belt 12 is attached to the outer belt 14 through the intermediary of a line of stitches or a plurality of lines of stitches 20. The stitch line 20 is one of at least three attachment points between the inner belt 12 and the outer belt 14. In the preferred embodiment a pair of female snap members 22 are located at opposite ends of the inner belt 12. They are adapted to mate with a pair of male snap members 24 located on the inside face of outer belt 14. Further details of the individual construction of the belt elements may be more fully appreciated with reference to FIGS. 2B–2H as described below.

Figure 2B:
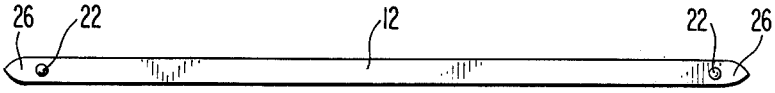
FIG. 2B illustrates the interior side of the inner belt of the present invention.
Figure 2C:
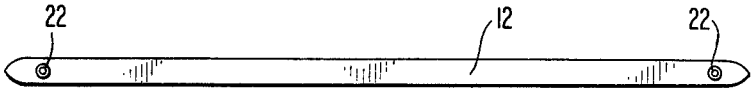
FIG. 2C illustrates the exterior side of the inner belt of the present invention.
Figure 2D:
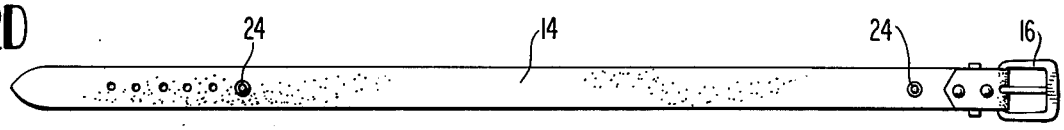
FIG. 2D illustrates the interior side of the outer belt of the present invention.

The inner belt 12 is illustrated in detail in FIGS. 2B and 2C. FIG. 2C shows the exterior face of the inner belt which comes into contact with the belt loops of the wearer and also impinges upon the inside face of the outer belt means as illustrated in FIG. 2D. FIG. 2B shows the corresponding interlock back face of the inner belt 12 which would normally come in contact with the waistband of a garment. The inner belt 12 is preferably shorter than the outer belt 14 when in position around the waist of a belt wearer. The opposite ends 26 of the inner belt 12 do not come into contact with each other but are preferably separated by a few inches. This is desirable so that the material does not bunch up under the buckle 16 thereby forcing it outward by an unnatural amount. The female snaps 22 are preferably located about an inch or more from the inner belt ends 26. The inner belt 12 is preferably made from a substantially rigid leather or leather-like material such as heavy cowhide or cordovan. It is important that the inner belt 12 have sufficient rigidity so that it can adequately support the outer belt 14 without causing the latter to sag. In certain applications the use of plastics could also be suitable. Another important parameter of the present invention is that the female snaps 22 be located at such a point that they contact their male counterparts 24 on the outer belt 14 at points intermediate the natural location of the belt loops thereon. The length of the inner belt 12 varies with the belt size of the wearer, For example, if the wearer has a 36 inch waist, the inner belt 12 might be 34 inches or less in length.

Figure 2E:
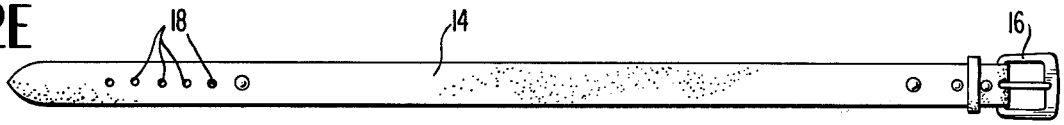
FIG. 2E illustrates the exterior side of the outer belt.

The outer belt 14 is illustrated in FIGS. 2D and 2E. The inside face of the outer belt 14 is illustrated in FIG. 2D. The inside face comes into contact with the belt loops of the wearer and with the exterior face of the inner belt 12 as illustrated in FIG. 2C. The exterior face of the outer belt 14 is illustrated in FIG. 2E. The exterior face is the face that would be seen once the belt is in place upon a wearer. While male snap fasteners 24 are visible on the exterior face of the outer belt 14, it is not necessary that they show. In some cases it may be desirable from an aesthetic point of view to conceal the presence of the snap fasteners. Since the outer belt 14 is not a load bearing belt in the sense that it is subjected to downward pressure by the belt loops at any particular point, it does not have to be made of material as rigid as the inner belt 12. The outer belt 14 serves two purposes in particular. First, it serves the function of cinching in the waistband of the wearer. Second, it is a decorative item. A great amount of latitude is allowable with the outer belt with regard to the selection of materials. That is to say, the outer belt 14 only requires moderate strength in the direction of its length, but does not require a great deal of strength in the direction of its width. This strength is contributed principally by the structure of the inner belt 12.

Figure 2F:
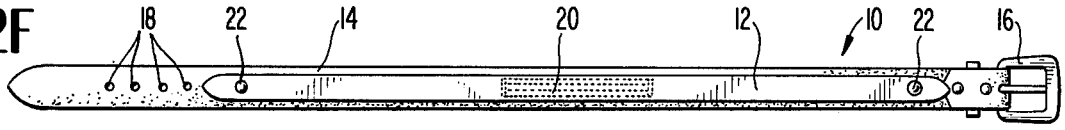
FIG. 2F is an interior view of the compound belt of the present invention showing the inner belt and the outer belt connected together.

The compound belt 10 is illustrated in a side elevational view in FIG. 2F. The belt 10 illustrated therein is also the same as the belt illustrated in perspective view in FIG. 2A. According to FIG. 2F the inner belt 12 is snap fastened to the outer belt 14 by fasteners 22. The belt loops of the wearer would fit in the pocket formed between the inner belt 12 and the outer belt 14 as further defined between the stitching 20 and the snap fasteners 22.

Figure 2G:
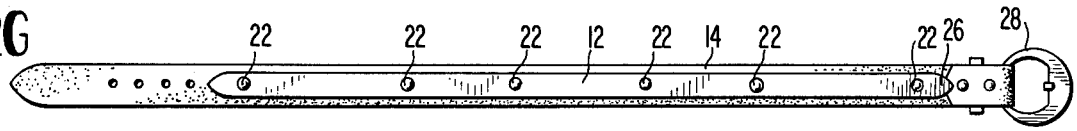
FIG. 2G illustrates an interior view of a compound belt according to an alternative embodiment of the present invention incorporating a plurality of releasable snap means.

An alternative belt embodiment 26 is illustrated in FIG. 2G. According to embodiment 26 six fasteners 22 are employed as the sole means of attachment between the inner belt 12 and the outer belt 14. The stitch fastening 20 has been replaced by fasteners 22. The additional snap fasteners 22 provide improved structural connection between the inner belt 12 and the outer belt 14. In addition, an alternative type of belt buckle 28 is illustrated to show that many different types of buckles can be employed according to the present invention.

Figure 2H:
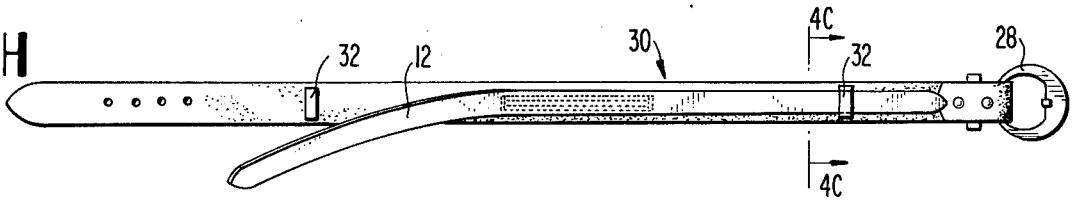
FIG. 2H illustrates an interior view of another alternative embodiment of the present invention incorporating loops on the outer belt adapted to receive the inner belt.

Yet another embodiment 30 of the present invention is illustrated in FIG. 2H. The embodiment 30 is similar to the embodiment illustrated in FIGS. 2A through 2F except for the addition of two inner belt guides 32 and the absence of snap fasteners.

Figure 4A:
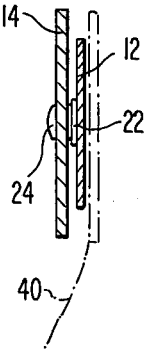
FIG. 4A is a cross-sectional view of the belt illustrated in FIG. 3D as seen from perspective 4A—4A.
Figure 4B:
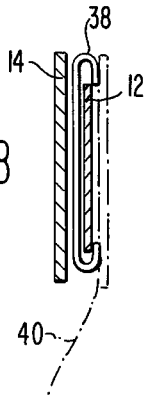
FIG. 4B is a cross-sectional view of the belt illustrated in FIG. 3C as seen from perspective 4B—4B.
Figure 4C:
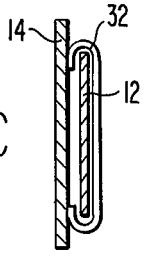
FIG. 4C is a cross-sectional view of the belt illustrated in FIG. 2H as seen from perspective 4C—4C.

The wearer first runs the inner belt 12 through his belt loops and then runs the ends of the inner belt through the inner belt guides 32. The outer belt 14 is then buckled in the conventional manner. FIG. 4C illustrates the structural relationship of the inner belt guides 32 to the inner and outer belts 12 and 14.

Another embodiment of the present invention employs an inner belt which equipped with a buckle so that it can buckle on the inside like a conventional belt. Unfortunately, such an approach would create interference problems between the inner buckle and the outer buckle unless the inner buckle is moderately thin.

Figure 3A:
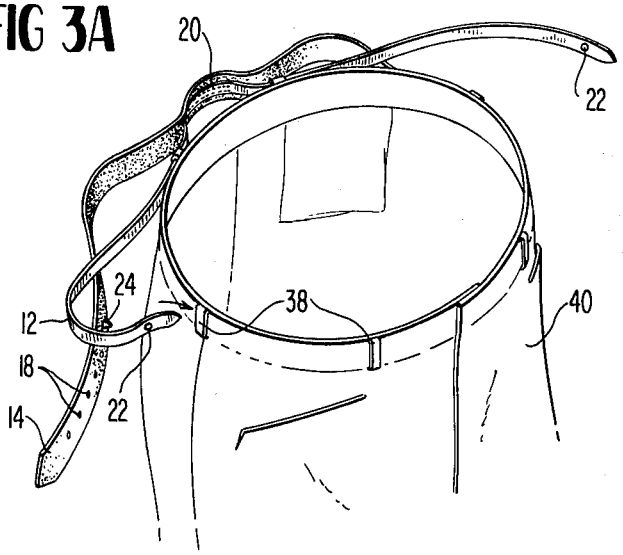
FIG. 3A illustrates the manner in which an individual places the inner belt through the belt loops of the garment.
Figure 3B:
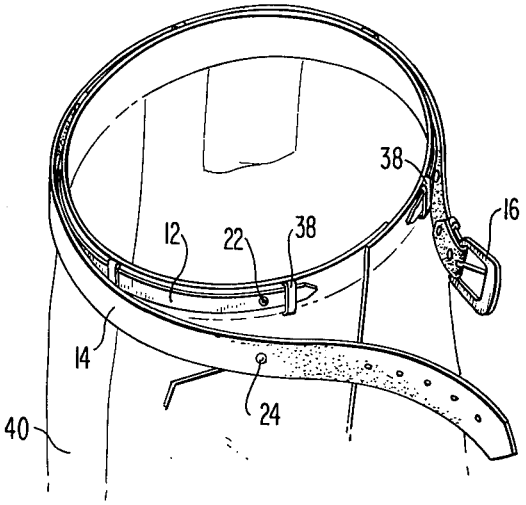
FIG. 3B illustrates the manner in which an individual might fasten the inner belt to the outer belt through the use of intermediary snaps.
Figure 3C:
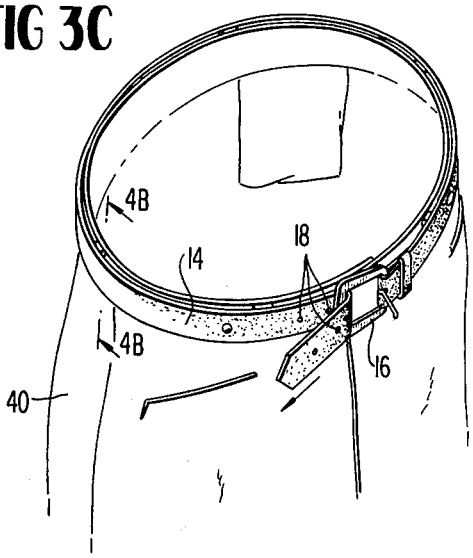
FIG. 3C illustrates the manner in which a user buckles the belt.
Figure 3D:
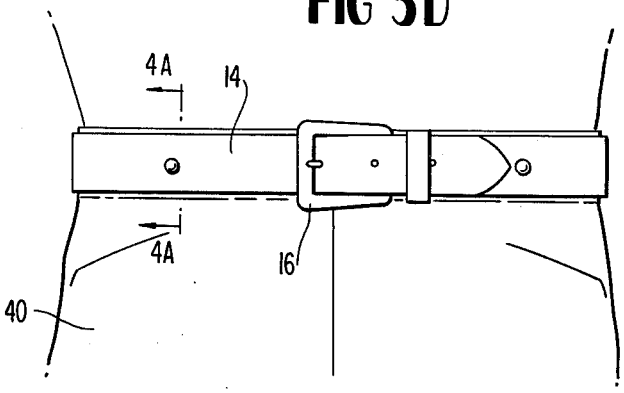
FIG. 3D illustrates the manner in which the belt user wears the belt invention.

FIG. 3A through 3D illustrate the manner in which a belt user attaches a compound belt 10 of the present invention to the belt loops of a pair of trousers. As shown in FIG. 3A the user first laces the inner belt 12 through the belt loops 38 on a pair of trousers 40. Typically starting with the inner belt portion as it exists between the stitch 20 and one of the two fasteners 22 the user will lace that portion through the belt loops starting with the first belt loop on one side of the center line of the back of the trousers and going forward in the normal manner. The other portion of the inner belt 12 is likewise laced through the other belt loops on the other side of the middle line in the back of the trousers. As discussed with reference to FIGS. 2A through 2G, the inner belt 12 preferably does not completely encircle the waistband of the user. In the next step as illustrated in FIG. 3B, the outer belt 14 is snap fastened to the inner belt 12 by forcing the male fastener 24 into the female fasteners 22. This might be done for example by inserting the thumb into the waistband of the trousers and forcing the snap means 22 and 24 together against the forefinger of the hand. The third step as shown in FIG. 3C. merely comprises the fastening of the belt buckle 16 at one end of the outer belt 14 to one of the receiving holes 18 in the other end of the outer belt. This step is performed in the same manner that an ordinary belt is fastened. A cross-sectional view of the belt shown in FIG. 3C is illustrated in FIG. 4B. The finished product is illustrated in FIG. 3D. A cross-sectional view of the buckled compound belt shown in FIG. 3D is illustrated in FIG. 4A. It will be noted that the belt loops 38 are substantially, if not entirely, hidden by the outer belt 14. As previously described, the inner belt 12 supports the outer belt 14 and serves to attach the upper portion of the trousers 40 to the outer belt 14. By cinching the outer belt as illustrated in FIG. 3 the trousers are accordingly given circumferential support.

While the belt described is a little more elaborate in structure than a conventional belt, it has been found that it is easy to put on and wear, especially after a little bit of practice. The only additional effort required in most cases is the snap fastening of the inner belt to the outer belt. The present invention also has the distinct advantage of keeping the belt on the pants of the wearer even when the outer belt is unbuckled.

It will be clear to those of ordinary skill in the art that certain changes in the invention can be made without departing from the spirit and scope of the invention. For example, while leather is the preferred material for the inner and outer belt members, there are also a variety of synthetic materials such as plastic which could do as well. A wide variety of belt buckles can be used in place of the ones illustrated, many of which do not depend upon receiving holes such as those illustrated as elements 18. Moreover, many types of fasteners 22 could be employed to produce the same effect. However, there are certain fasteners which are believed to be less desirable than those illustrated. For example, it is believed that fasteners of the VELCRO type family produce an item which is too bulky in appearance.

It is not absolutely necessary that the inner belt be permanently bonded to the outer belt. As a matter of fact, as illustrated in one alternative embodiment, the inner belt and outer belt could be separable by means of snap fasteners. Accordingly, such a belt could be worn by first lacing the inner belt through the belt loops and then snapping the outer belt on to it.

Another embodiment of the invention comprehends a substantially rigid inner belt attached at one discrete point in the center thereof to the outer belt. The exterior side of the inner belt and the interior side of the outer belt would be provided with non-skid surfaces, such as abrasions, which prevent the outer belt from slipping or otherwise moving relative to the inner belt. Extra belt stability would be achieved by the contact of the non-skid surface of the outer belt with the fabric of the garment itself.

While lines of stitches are illustrated as the preferred method of joining the inner belt to the outer belt, it will be appreciate that other joining means are possible as well. For example, adhesives, rivets, staples and other conventional fasteners could be employed. Glue could be used to bond leather to leather; solvents, hot melt glues or ultrasonic methods could be used to bond plastic to plastic.

I claim:

1. A belt apparatus for covering the belt loops of a garment, said apparatus comprising:

an inner belt means for engaging the belt loops of said garment, said inner belt means having a predetermined width and comprising a material having substantial rigidity in at least one dimension;

an outer belt means having a width greater than the predetermined width of said inner belt means and adapted to substantially surround said inner belt means;

a first discrete attaching means for attaching said inner belt means to said outer belt means, said first discrete attaching means being located approximately in the middle of said inner and outer belt means respectively;

a second discrete attaching means attached to said inner belt means and located at one end thereof;

a third discrete attaching means attached to said inner belt means and located at the opposite end of said inner belt means from said second discrete attaching means;

a pair of complementary attaching means attached to said outer belt means and adapted to mate with said second and third discrete attaching means respectively; and, a buckle means for securing said outer belt means relative to itself.

2. The belt apparatus of claim 1 wherein the inner belt means comprises a leather-like material.

3. The belt apparatus of claim 2 wherein said first attaching means comprises at least one lateral line of stitches running in a direction parallel to the long dimension of said inner and outer belt means.

4. The belt apparatus of claim 3 wherein said second and third attaching means comprise snap type fasteners.

5. The belt apparatus of claim 1 wherein said first, second and third attaching means comprise snap-type fasteners.

6. The belt apparatus of claim 5 further including additional attaching means comprising snap-type fasteners.

7. The belt apparatus of claim 1 wherein said inner belt means and said outer belts means are made from plastic-like materials.

8. The belt apparatus of claim 1 wherein said inner belt does not completely encircle the waist of an individual when said outer belt is buckled.

9. A belt apparatus for covering the belt loops of a garment, said apparatus comprising:

an inner belt means for engaging the belt loops of said garment, said inner belt means having a predetermined width and comprising a material having substantial rigidity in at least one dimension;

an outer belt means having a width greater than the predetermined width of said inner belt means and adapted to substantially surround said inner belt means;

a first discrete attaching means located approximately in the middle of said inner and outer belt means respectively;

a second discrete attaching means comprising a first loop means attached to said outer belt means and adapted to recieve one end of said inner belt means;

a third discrete attaching means comprising a second loop means attached to said outer belt means and adapted to receive the opposite end of said inner belt means; and, a buckle means for securing said outer belt means relative to itself.

10. A belt apparatus for covering the belt loops of a garment, said apparatus comprising:

a substantially rigid inner belt means for engaging the belt loops of said garment, said inner belt means having a predetermined width;

an outer belt means having a width greater than the predetermined width of said inner belt means and adapted to substantially surround said inner belt means;

at least one discrete attaching means for attaching said inner belt to said outer belt, further means for preventing the movement of said outer belt relative to said inner belt, said further means comprising a non-skid-like surface on at least one of said belt means; and, a buckle means for securing said outer belt means relative to itself.

* * * * *

UNITED STATES PATENT OFFICE

CERTIFICATE OF CORRECTION

Patent No. 4,063,313 Dated December 20, 1977

Inventor(s) Frederick K. Hagios

It is certified that error appears in the above-identified patent and that said Letters Patent are hereby corrected as shown below:

On the cover sheet the illustrative figure should appear as shown below.

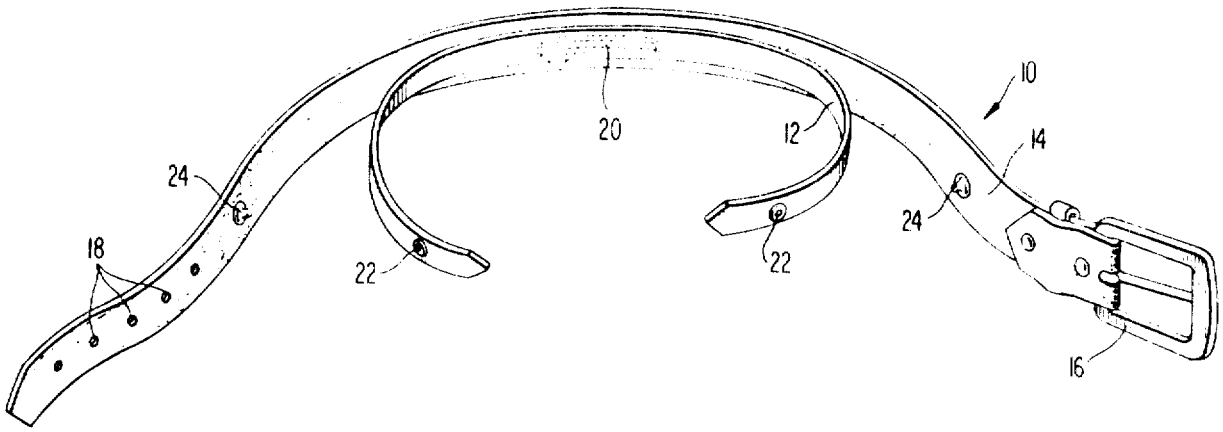

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*